US006084146A

United States Patent [19]

Barkatt et al.

[11] Patent Number: 6,084,146

[45] Date of Patent: Jul. 4, 2000

[54] IMMOBILIZATION OF RADIOACTIVE AND HAZARDOUS CONTAMINANTS AND PROTECTION OF SURFACES AGAINST CORROSION WITH FERRIC OXIDES

[75] Inventors: Aaron Barkatt, Silver Spring; Ewa Labuda, Bowie; Marta Gmurczyk, Silver Spring, all of Md.; Donna M. Wilder, Washington, D.C.

[73] Assignee: Consolidated Edison Company of New York, Inc., New York, N.Y.

[21] Appl. No.: 08/713,243

[22] Filed: Sep. 12, 1996

[51] Int. Cl.[7] ..... G21F 9/00

[52] U.S. Cl. ..... 588/10; 588/252; 588/18; 588/20; 428/469; 501/155; 264/681; 427/370; 134/4

[58] Field of Search ..... 588/10, 14, 15, 588/20, 252, 18; 428/469; 134/4; 501/155; 427/370; 264/681

[56] References Cited

U.S. PATENT DOCUMENTS

| | | | |
|---|---|---|---|
| 2,728,696 | 12/1955 | Singer . | |
| 3,944,683 | 3/1976 | Church et al. . | |
| 4,014,766 | 3/1977 | Watanabe et al. . | |
| 4,086,182 | 4/1978 | Hengelhaupt et al. . | |
| 4,108,769 | 8/1978 | Krieg et al. . | |
| 4,118,243 | 10/1978 | Sandesara . | |
| 4,241,039 | 12/1980 | Koh et al. . | |
| 4,318,788 | 3/1982 | Duffey . | |
| 4,343,706 | 8/1982 | Etzel et al. . | |
| 4,369,073 | 1/1983 | Fukutsuka et al. . | |
| 4,389,254 | 6/1983 | Tusset et al. . | |
| 4,427,034 | 1/1984 | Nagata et al. . | |
| 4,454,098 | 6/1984 | Scheithauer et al. . | |
| 4,508,641 | 4/1985 | Hanulik . | |
| 4,518,508 | 5/1985 | Conner . | |
| 4,601,832 | 7/1986 | Hooykaas . | |
| 4,606,829 | 8/1986 | Rice et al. . | |
| 4,642,203 | 2/1987 | Matsunaga et al. . | |
| 4,642,204 | 2/1987 | Burstrom et al. . | |
| 4,649,019 | 3/1987 | Jawor . | |
| 4,680,126 | 7/1987 | Frankard et al. . | |
| 4,693,798 | 9/1987 | Gale et al. . | |
| 4,726,895 | 2/1988 | Martinez . | |
| 4,834,917 | 5/1989 | Ramm et al. . | |
| 4,970,079 | 11/1990 | Hem et al. . | |
| 5,013,453 | 5/1991 | Walker . | |
| 5,073,305 | 12/1991 | Miyao et al. . | |
| 5,093,007 | 3/1992 | Domvile . | |
| 5,106,508 | 4/1992 | Schwitzgebel . | |
| 5,177,305 | 1/1993 | Pichat | 588/257 |
| 5,221,323 | 6/1993 | Li . | |
| 5,252,003 | 10/1993 | McGahan . | |
| 5,290,589 | 3/1994 | Clough et al. . | |
| 5,292,435 | 3/1994 | Schwitzgebel . | |
| 5,302,565 | 4/1994 | Crowe | 501/141 |
| 5,326,439 | 7/1994 | Brewster . | |
| 5,330,658 | 7/1994 | Grant et al. . | |
| 5,352,517 | 10/1994 | Clough et al. . | |
| 5,358,643 | 10/1994 | McClintock . | |
| 5,505,857 | 4/1996 | Misra et al. . | |
| 5,520,917 | 5/1996 | Mizuguchi et al. . | |
| 5,678,235 | 10/1997 | Crowe | 588/9 |
| 5,732,564 | 3/1998 | Kujawa et al. | 219/121.36 |

FOREIGN PATENT DOCUMENTS

| | | |
|---|---|---|
| 63-25598 | 2/1968 | Japan . |
| 63-127199 | 5/1988 | Japan . |

OTHER PUBLICATIONS

"Steam Generator Sludge at the Indian Point 2 Nuclear Station: Implications to Tube Corrosion", A. Barkatt et al., Corrosion 95, The NACE Annual Conference and Corrosion Show, Paper No. 453, pp. 453/1–453/9; Mar. 1995.

"Characterization of Sludge from Indian point 2", A. Barkatt et al., EPRI PWR Sludge Management Workshop, pp. 21–1–21–17; May 1994.

"Composition, Characteristics and Study of Sludge Formation in the Indian Point 2 PWR Steam Generators", A Barkatt et al., Corrosion 93, The NACE Annual Conference and Corrosion Show, Paper No. 365, pp. 365/1–365/6; 1993.

"Characterization and Simulation of Hematite–Rich Deposits in PWR Steam Generators", A. Barkatt et al., NE–Vol. 8, Steam Generator Sludge Deposition in Recirculating and Once Through Steam Generator Upper Tube Bundle and Support Plates, eds. R.L. Baker et al., ASME, New York, N.Y., pp. 69–73; 1992.

"Studies of the Properties and Build–Up of Hard Sludge at Indian Point 2", A. Barkatt et al., EPRI PWR Plant Chemists' Meeting, Nov. 1992.

"Immobilisation of high level nuclear reactor wastes in SYNROC", A.E. Ringwood et al., Nature, vol. 278, pp. 219–223; Mar. 15, 1979.

"Synroc Production Using A Fluid Bed Calciner" Ackerman et al., Mat. Res. Soc. Symp. Proc. vol. 15 (1983), pp. 63–71.

"The SYNROC process: A geochemical approach to nuclear waste immobilization", A.E. Ringwod et al., Geochemical Journal, vol. 13, pp. 141–165; 1979.

"Evolution, Composition and Properties of Steam Generator Sludge at Indian Point 2: Modeling and Observations", A. Barkatt, Proceedings: PWR Plant Chemistry Meeting, vol. 2, Sessions 4–8; Feb. 1996, based on a presentation given Nov. 1–3, 1995.

*Primary Examiner*—Ngoclan Mai
*Attorney, Agent, or Firm*—Morgan & Finnegan, L.L.P.

[57] ABSTRACT

Processes for immobilizing solid contaminated materials, such as radioactive species, hazardous species, or combinations of both radioactive and hazardous species, comprise mixing the contaminated materials with hydrated ferric oxides, and then pressing the mixture at a temperature of at least about 150° C. and gradually removing a large part of the water while under pressure to produce a solid composition. The water content of the mixture is adjusted if necessary. Contaminated materials dissolved or suspended in an aqueous solution can be immobilized by precipitating hydrated ferric oxide in the solution, and adjusting the water content and pressing, as above. In another process in accordance with the present invention, hydrated ferric oxides are deposited on metal surfaces. The deposited ferric oxide is pressed to produce a solid coating adhered to the surface, to retard corrosion. A ceramic body of ferric oxide composition may also be made in accordance with the present invention.

86 Claims, 1 Drawing Sheet

IMMOBILIZATION OF RADIOACTIVE AND HAZARDOUS CONTAMINANTS AND PROTECTION OF SURFACES AGAINST CORROSION WITH FERRIC OXIDES

FIELD OF THE INVENTION

This invention relates to a method and composition for immobilizing solid or aqueous contaminated materials including radioactive wastes and non-radioactive hazardous materials, to facilitate their safe disposal. More particularly, the invention relates to producing a solid composition containing the contaminated material for its convenient and safe disposal. Corrosion resistant coatings and ceramic bodies may also be produced using the solid composition.

BACKGROUND OF THE INVENTION

Radioactive and hazardous waste disposal continues to present technical, environmental and economic problems. Containment of such contaminated waste materials, which are often in the form of liquid solutions, wet slurries and particulate solids, such as soil particles or ion exchange resin beads, is difficult. In addition, the volume of contaminated wastes requiring disposal has been growing, while available storage space is limited. The cost of storing such wastes is therefore rising. Reducing the volume of the wastes is important to minimize costs. Major efforts have therefore been expended in recent decades to develop compact waste form materials with high resistance to cracking, pulverization, corrosion and leaching. Such efforts have met with limited success.

Borosilicate glasses, for example, have been used to contain wastes for disposal. Such glasses, however, have high melting temperatures (1100–1450° C.). Many radioactive contaminants, such as cesium and ruthenium, have oxides which volatize at those high temperatures, requiring large off-gas treatment systems. In addition, the need for materials resistant to high temperature corrosion in the processing system and the high energy requirements of the system result in high costs.

Cement is also used to contain wastes. While containment in cement is a relatively inexpensive, low temperature process, cement is susceptible to leaching and cracking upon exposure to aqueous environments. In addition, cement enables only limited reduction in the volume of the contaminated material.

Incineration, vitrification, metal melt and pyrolysis have also been proposed for the immobilization and volume reduction of hazardous wastes. Incineration and vitrification, however, pose a significant risk of gaseous release of hazardous wastes to the environment. Currently, metal melt and pyrolysis are only available for the disposal of slightly contaminated wastes.

Resistance to corrosion is a basic consideration in the selection of appropriate materials for waste immobilization, as well as in the protective coating of materials. The susceptibility of various metals to corrosion is determined by their standard electrochemical potentials and the properties of their oxides. Aluminum, for example, has a high oxidation potential, but its oxide forms a continuous film which strongly adheres to the metal surface, protecting the aluminum metal against further attack. In the case of iron, oxides associated with both the +2 (ferrous) and +3 (ferric) oxidation states can be formed in corrosion processes. In pure water environments, the major corrosion product is the black ferrous-ferric oxide magnetite ($Fe_3O_4$). Magnetite films on steel are moderately protective. In the presence of dissolved oxygen as well as chloride or sulfate ions, however, the corrosion products become fully oxidized to the ferric state. These corrosion products include a variety of more hydrated and less hydrated ferric oxides, which form non-adherent, flake-like, non-protective films. Thus, when iron and steel become covered with rust, the corrosion process is not arrested, but continues to attack progressively deeper regions.

The ultimate product of drying ferric oxides is hematite ($Fe_2O_3$), which is a widely used pigment. The formation of hematite from hydrated iron oxides generally results in the formation of a loose, non-consolidated, powdered product.

Iron oxides have been used to immobilize hazardous materials. The resulting products, however, are powders. U.S. Pat. No. 5,221,323 to Li et al., for example, discloses methods of waste treatment by producing magnetic powders from heavy metal sludges by adding ferric compounds, such as ferric hydroxide or ferric oxide. The mixture is heated in an oven at 500–1400° C. and then cooled. Li's examples are at 1,000–1,200° C. The resulting powders are ground. A weak acid solution or inorganic sodium salts are added to the ground powders to aid in the separation of magnetic materials with a magnetic separator. The magnetic powders are then dried. Processes at temperatures above 500° C., and particularly those over 1,000° C., release volatile oxides which can contaminate the environment. Furthermore, powders stored in a containment vessel can be released into the air or the ground water if the vessel is damaged or disintegrates.

The precipitation of hydrated ferric oxide from aqueous solutions can be used to remove dissolved or suspended contaminants from such solutions through co-precipitation, sorption or both. A substantial fraction of certain contaminants, such as cobalt-60, can be removed from solution in this manner. The resulting material is typically a wet sludge or dried powder.

Powders have been treated to resist leaching by water. U.S. Pat. No. 4,601,832 to Hooykaas, for example, discloses treating waste material, including hazardous metals, with an acid solution of iron and preferably manganese to dissolve the hazardous metal. The waste material can be sludge, for example. The solution is made alkaline by the addition of ammonia to precipitate the hydroxides of the hazardous metals and the hydroxide of the iron or manganese. The mixture of hydroxides is air dried. Consolidation of the dried precipitate is specifically avoided. The particles are mixed with a water repellent substance, such as a polymeric silicon compound.

Contaminated materials containing iron compounds have been consolidated with binding materials. U.S. Pat. No. 4,508,641 to Hanulik, for example, discloses disposing of waste generated upon the decontamination of steel surfaces in radioactive facilities by treating the wastes, which contain iron, to precipitate insoluble iron compounds or iron hydroxide. The iron compounds are decomposed into iron oxide, which is consolidated in cement. U.S. Pat. No. 4,118,243 to Sandesara uses iron oxides to immobilize arsenic in solid or liquid waste material. The product is incorporated in a calcium sulfate matrix. The use of porous binding materials, such as cement or calcium sulfate, limits the amount of volume reduction which can be achieved. In addition, the presence of other materials may interfere with the formation of the matrix. Cement and calcium sulfate are also prone to leaching.

Protective ferric oxide coatings have been formed on surfaces by the treatment of the surface with acids. U.S. Pat.

No. 2,728,696 to Singer, for example, discloses producing an adherent coating of hydrated ferric oxide on iron, steel and objects having a ferrous surface, by first forming a film of a dilute aqueous solution of acid or acid-reacting salt on the surface of the object to be coated. The film reacts with the surface of the object, yielding ferrous oxide, which is oxidized in humid air. U.S. Pat. No. 4,369,073 to Fukutsuka et al., discloses formation of a thin corrosion protective coating on the inner surface of a condenser tube made of a copper alloy. A thin layer of an acidic suspension containing iron powder is applied to the surface, which is then exposed to an oxidizing gas. The resulting film comprises ferric oxyhydroxides. The acid residues in the methods of Singer and Fukutsuka could cause local corrosion beneath the coating. Singer's method is also not applicable to coating materials which do not comprise ferrous alloys, such as stainless steel. Neither reference discloses the direct deposition of ferric oxide on a surface.

It is expected that the costs of immobilization and storage of hazardous wastes will continue to rise. A safe and secure immobilization process which is easy to implement and yields a solid product of reduced volume, is needed.

SUMMARY OF THE INVENTION

It has been found that steam generator tubes in certain nuclear power plants have developed ferric oxide coatings which protect them from corrosion. Corrosion of carbon steel pipes which are exterior to and feed water into the generator, yields hydrated iron oxide and dissolved iron ions in the water. The hydrated iron oxide and iron ions are carried by the water and deposited on the steam generator tubes, which are commonly Alloy 600 (an alloy of 76% nickel, 16% chromium, and 7% iron). The hydrated ferric oxides form a corrosion resistant coating of 1–3 mm which adheres well to the Alloy 600. The coating develops over a period of about several months. Nanocurie to microcurie levels of radioactive material per gram, which leak into the generator, have been found within the coating.

Surprisingly, it has been found that under certain combinations of temperature, pressure, initial water content, and time, a hydrated ferric oxide precursor can be consolidated into a solid composition with high hardness and crush strength and low leachability. Temperatures of less than about 500° C. can be used. Such solid compositions can be used to contain and thereby immobilize contaminated materials in solid form and dissolved in aqueous solutions. They can also be used in coating surfaces to retard corrosion, and in forming ceramic bodies.

In accordance with one embodiment of the present invention, a process for immobilizing contaminated solid materials comprises mixing the contaminated materials with hydrated ferric oxide, and pressing the mixture at a temperature of at least about 150° C. and gradually removing a large part of the water while under pressure for a period of time to produce a solid composition containing the contaminated materials. The amount of hydrated ferric oxide comprises at least about 20% $Fe_2O_3$, by dry weight of the total weight of the composition. Preferably, the amount is at least about 30%. The water content of the mixture is adjusted if necessary to be within a range of about 5% to about 40% of the weight of the mixture of hydrated ferric oxide and the contaminated material. About 10% to about 30% is preferred. The water content of the resulting composition is preferably between about 2.0% to about 7.0%. The temperature of the pressing process is preferably greater than 150° C., less than 500° C. and more preferably is between about 180–400° C. Pressures of about 15,000 psi to about 90,000 psi may be used for periods of time of from about 2.5 to about 5 hours, for example.

In accordance with a second embodiment of the invention, a process for immobilizing contaminated materials contained in an aqueous solution comprises precipitating hydrated ferric oxide from solution to incorporate at least a fraction of the contaminated materials, and pressing the mixture at a temperature of at least about 150° C. and gradually removing a large part of the water while under pressure for a period of time to produce a solid composition containing the contaminated materials. The water content of the precipitate is adjusted, if necessary. The ferric oxide content, water content, temperatures and pressures referred to in the first embodiment of the invention, are preferred.

The solid composition resulting from the processes of the first and second embodiments is a third embodiment of the present invention. The solid composition comprises a matrix of ferric oxide and contaminated materials distributed throughout and encapsulated by the matrix. The ferric oxide content of the composition is preferably at least about 20% $Fe_2O_3$, by dry weight of the total weight of the body. Preferably, the ferric oxide content is at least about 30% $Fe_2O_3$. If the contaminated material is radioactive, the body can effectively immobilize contaminated material with low level radioactivity in the nanocurie per gram to millicurie per gram range. The water content of the composition is preferably between about 0.1% to about 10.0%, and is more preferably between about 2.0% to about 7.0%.

In accordance with a fourth embodiment of the invention, a process for coating a surface comprises depositing on the surface a composition comprising hydrated ferric oxide, and pressing the ferric oxide at a temperature of at least about 150° C. and gradually removing a large part of the water while under pressure for a period of time to produce a solid coating adhered to the surface. The water content is adjusted if necessary. The coated article is a fifth embodiment of the invention.

In accordance with a sixth embodiment of the invention, a process for producing a ceramic body comprises precipitating hydrated ferric oxide, and pressing the mixture at a temperature of at least about 150° C. and gradually removing a large part of the water while under pressure for a period of time to produce a solid composition. The water content is adjusted, if necessary.

The introduction of additives to facilitate the consolidation and hardening process or to enhance the mechanical properties of the solid composition is optional in all the embodiments of the invention. For example, certain additives may be used to facilitate the formation of the hard, consolidated ferric oxide composition by reducing the required pressure, temperature, or duration of the process, or to improve the properties of the product, such as its hardness, strength, and adhesion to metal surfaces. Such additives include substances used or proposed for use as ceramic binders, alumina, silica, silicates, aluminosilicates, phosphates, phosphoric acid, titania, titanates, and metal fines such as iron powder.

DESCRIPTION OF THE INVENTION

Figure 1:
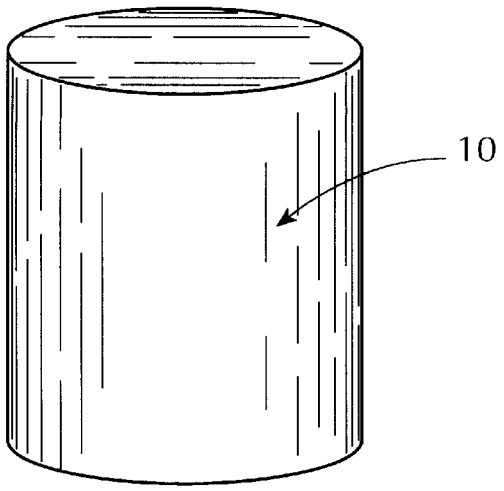
FIG. 1 is a side view of a solid composition containing contaminated materials in accordance with an embodiment of the present invention.

In the first embodiment of the present invention, solid contaminated materials are immobilized by mixing the solid materials with hydrated ferric oxide, adjusting the water content of the mixture, and hot pressing the mixture and gradually removing a large part of the water while under pressure for a period of time to produce a solid composition. The materials can be contaminated with radioactive materials, hazardous materials, or both. The radioactive materials can be in the range of nanocuries per gram to millicuries per gram of the solid composition. Hazardous species are non-radioactive materials, such as certain heavy metals, which are toxic to humans or other life forms. Contaminated materials which can be immobilized or stabilized according to the process of this embodiment of the invention include oxides, metal fines, soluble and insoluble salts, organic ion exchangers, inorganic ion exchangers such as zeolites, sorbents, polymers, soils, sludges, and corrosion products of metal objects such as magnetite, for example. The process of the present invention is believed to be particularly useful in immobilizing alumina and silica containing material, such as soil.

To improve mixing with the hydrated ferric oxide, reduce drying time, and increase the initial amount of material which can be immobilized, the contaminated materials are preferably in the form of particles no larger than about 50 microns. More preferably,the particles are less than about 10 microns. Grinding at moderate temperatures may be used to reduce the particle size, if necessary. The contaminated materials may also be dried at between about 100° C.–250° C., to aid in the grinding process. In the case of ion exchange resins, particle size reduction by a combination of grinding and drying has been found to be most effective. Particle size may also be reduced during mixing of the contaminated solids with the hydrated ferric oxide by mixing techniques such as ball milling. Soluble salts, such as cesium nitrate or cobalt nitrate, or well-powdered solids such as commercial mercury oxide powder, require no pretreatment. While not preferred, particle sizes of up to about 200 microns could be used in the process of the present invention, with high amounts of ferric oxide, as will be discussed.

The properly sized contaminated solids are mixed with hydrated ferric oxide. A slurry of hydrated ferric oxide may be prepared by adding a base to a solution of a ferric salt at a pH in the near-neutral or alkaline range. A pH of between about 7.5–8 has been found to enable more complete precipitation at a faster rate, yielding fine particles. The base is preferably a solution of ammonium hydroxide. The ferric salt is preferably ferric nitrate. The base is preferably added slowly and with stirring to the salt. For example, a concentrated solution of ammonia can be slowly added to a solution containing approximately 28% of ferric nitrate ($Fe(NO_3)_3$) in water with stirring until the pH reaches about 7.5–8. The initial slurry typically contains about 10 grams of suspended ferric oxide precipitate by dry weight per 100 mL of aqueous solution. It is preferred that at least a majority of the hydrated ferric oxide be ferrihydrite.

The slurry is preferably filtered to separate the free-standing water. The amount of water remaining in the slurry is preferably about 50% of the weight of the ferric oxide or about one-third of the total weight of the slurry. Coarse filter paper or a mesh screen with a mesh size of about −200 may be used to separate slurry of less than about 75 microns for subsequent use in the process of the invention. The precipitate should be fresh. It has been found that allowing the precipitate to sit for more than several days interferes with its ability to consolidate.

The contaminated materials are then added to the fresh precipitate. The contaminated material is thoroughly mixed with the hydrated ferric oxide precipitate and the total water content of the mixture is preferably adjusted, if necessary, to be between about 5% to about 40% by weight of the mixture. About 10% to about 30% is preferred. Water content for the purpose of this invention includes molecular water in free, occluded or sorbed form, as well as water of hydration and hydroxyl groups. It has been found that most contaminated materials can be readily pressed into a hard, consolidated composition when the water content before pressing is between about 10%–30%.

The water content may be adjusted by sampling the mixture, heating the samples to determine the loss of weight corresponding to the water present in the samples, and calculating how much water has to be added to the mixture or removed by drying to achieve the desired water content. Since it may be difficult to stop the drying process when the preferred water content is reached uniformly throughout the mixture, it may be found preferable to dry the mixture by moderate heating to remove the free-standing water and then to add the required amount of water to reach the desired water content. The mixture can be dried at about 110° C. for 12–18 hours, for example.

The hydrated ferric oxide comprises at least about 20% $Fe_2O_3$ of the dry weight of the mixture. Preferably, the hydrated ferric oxide is greater than about 30% $Fe_2O_3$ of the dry weight of the mixture. If volume reduction is not a consideration or the contaminated materials have particle sizes of about 50–200 microns, the hydrated ferric oxide as $Fe_2O_3$ is preferably at least about 50%, and more preferably greater than about 70% of the dry weight of the mixture. It has been found that hydrated ferric oxide of at least about 30% $Fe_2O_3$ is sufficient for consolidation of most contaminated solid material. Certain materials, such as copper and cuprous oxide ($Cu_2O$), can be consolidated with at least about 20% hydrated ferric oxide.

Preferably, the slurry of hydrated ferric oxide is mixed with the contaminated materials after filtration of the slurry to reduce the amount of contaminated water developed by the process. Soluble materials, such as cesium nitrate and cobalt nitrate, for example, must be added after filtration.

The mixture is then pressed while gradually further reducing the water content to consolidate the ferric oxide into a matrix surrounding the particles of the contaminated materials, which are dispersed throughout the matrix. Pressure may be applied by any of a variety of techniques which permit the removal of water as water vapor. For example, hot uniaxial pressing ("HUP"), hot isostatic pressing ("HIP") and autoclaving systems can be adapted to enable the removal of water vapor. During hot pressing, the water content is preferably reduced to a final level of about 0.1–10.0% for adequate consolidation. A final water content of about 2.0% to about 7.0% is preferred. It is believed that after hot pressing, at least a majority of the ferric oxide in the resulting solid, consolidated composition comprises hydrohematite. It is also believed that most of the water present in the solid composition is in the form of water of hydration or hydroxyl groups.

The hot pressing and water removal needs to be conducted at a temperature of at least about 150° C. A temperature less than about 500° C. is preferred to minimize the off-gas release of volatile oxides to the environment. A preferred temperature range is about 180° C. to about 400° C.

The hot pressing and water removal step is conducted for a period of time necessary to consolidate the mixture into a solid composition at a particular pressure and temperature. High pressures require less time to consolidate the mixture while low pressures require more time, at a given temperature. In addition, higher temperatures could enable the use of lower pressures and/or less time. If pressures of between about 60,000 psi to about 90,000 psi are used at a temperature of about 240° C. to about 270° C., for example, the hot pressing and water removal step could require about 2.5 hours to about 5 hours. Pressures below about 60,000 psi at that temperature range could also be used with longer periods of time. Pressures as low as 800 psi are conceivable if time is not a factor. Pressures of about 15,000 psi to about 30,000 psi could be used in a hot pressing procedure of about 2 to 4 hours at a temperature of between about 240° C. to about 280° C., for example, if additives are provided in the mixture, as discussed below. At high pressures and temperatures, and the use of additives, several minutes could be sufficient for the hot pressing and water removal step. Since the pressure, temperature and duration of the hot pressing will impact the costs of the procedure, these factors would be balanced in a commercial implementation.

HUP and HIP are preferred hot pressing techniques which are routinely used in the ceramic industry and have been proposed for use in large-scale processing of nuclear waste. See, for example, F. J. Ackerman et al., Mat. Res. Soc. Symp. Proc., Vol. 15, pp. 63–70 (1983) ("Ackerman"); U.S. Pat. No. 5,073,305 to Miyao et al. ("Miyao"); and U.S. Pat. No. 4,642,204 to Burström et al. ("Burström"), which are incorporated by reference herein.

In HUP, the mixed powder is placed between pistons in a heated cylindrical die and pressure is applied axially, as is known in the art. The mixture can be pressed at about 70,000–80,000 psi for about three–four hours at about 250–260° C., for example, to achieve a hard, consolidated product. The die cavity in the HUP process needs to be provided with outlet tubes, preferably connected to a vacuum system, to remove water as vapor during the hot pressing process. Miyao discloses a method of treating radioactive wastes in which a container is evacuated to a vacuum prior to an HUP or HIP procedure. The system in Miyao could be readily adapted for evacuation during pressing.

In HIP, the mixed powder is placed in a collapsible steel can or drum, which may be bellows shaped, as is known in the art. See FIG. 1 of Ackerman, for example. Densification takes place in a fluid pressurized chamber where the pressure is applied on all sides of the can. The can in the HIP process disclosed in Ackerman needs to be provided with outlet tubes, preferably connected to a vacuum system, for the removal of water vapor. Burström discloses a bellows shaped container with an evacuation tube for use in HIP. The preferred pressures, temperatures and times discussed above, are applicable.

The amount of water removed during hot pressing can be monitored by measuring the amount of water vapor removed. It has been found, however, that proper adjustment of the water content of the mixture to within the preferred ranges, at the pressures, temperatures and time periods described herein, yields a consolidated material with a water content within the preferred ranges.

The presence of additives such as metallic iron powder enables the use of lower pressures, such as about 15,000 psi to about 30,000 psi, for about the same amount of time or even less time than that required at the higher pressures discussed above, without the use of additives. See Example 7, below. The particles of the powder are preferably no larger than about 100 microns. Other possible additives are discussed, below. The additives do not negatively affect the characteristics of the consolidated product. Even without additives, pressures lower than about 60,000 psi could be used if the hot pressing process is conducted for longer than about four or five hours.

The densified, consolidated solid composition formed by HUP may be removed and placed in a containment vessel, such as a can or drum, for underground burial or other such disposal. Cans or drums for contaminated material disposal are typically available in 55, 30, 20 and 8 gallon sizes. In the case of HIP, the product is already enclosed within a can as it is removed from the press. Because of its hardness, strength, and resistance to leaching and crushing, the consolidated composition containing radioactive and hazardous materials maintains its integrity even if the containment vessel is broken or disintegrates. The immobilized radioactive and hazardous materials will not, therefore, disperse into the air or ground water.

Volume reduction of the solid contaminated material of at least about ten times is possible by the process of the present invention, dependent on the type of contaminated material. Ion exchange resins, for example, can be reduced in volume by at least about 3–10 times, as the hot pressing collapses the pores and pyrolyzes the resin. Non-porous powders, such as mercuric oxide, are already relatively compact, and further volume reduction of about two times is achievable. Porous materials, such as soil, can be reduced in volume by about three to four times.

In one example of the process of the present invention, a 90% hydrated ferric oxide slurry is mixed with 10% by weight of soil contaminated with cobalt oxide, mercury oxide and uranium oxide. The mixture is filtered, dried, and mixed with about 25% water by weight. The rewetted mixture is pressed by an HUP process at about 260° C. at about 70,000 psi for about 4 hours to yield a hard, consolidated composition.

As mentioned above, other species can be included in the mixture prior to pressing to facilitate consolidation and to enhance mechanical properties. For example, certain additives, such as metallic iron powder, can reduce the required pressure, temperature or duration of the hot pressing process. Certain additives, such as calcium phosphate, may also improve the hardness and strength of the solid body. Other additives include metal oxides, such as aluminum oxide, cupric oxide and zinc oxide, ceramic binders, alumina, silica, silicates, aluminosilicates, phosphates, phosphoric acid, titania, and titanates, for example. Such species can be incorporated into the product by co-precipitation, mixing, or both, with the hydrated ferric oxide. Aluminum oxide, cupric oxide or zinc oxide may be precipitated by adding a base to an aluminum, copper or zinc salt solution, respectively. The precipitates are then added to the ferric oxide slurry. A fine particulate material suspended in water, such as silica gel, magnetite or cuprite, can also be added to the slurry after most of the water has been removed by filtration.

The amount of additives should not lower the ferric oxide content of the solid composition below about 20%. The preferred percentages of ferric oxide discussed above are also applicable when additives are included. The total amount of other solid species which can be added to the hydrated ferric oxide without changing the mechanical properties of the consolidated composition can be up to about 80%, depending on the quantity, composition and particle size of the contaminated material.

Thus, a solid composition containing 61.6% $Fe_2O_3$, 15.9% $Fe_3O_4$, 14.9% CuO, 3.0% ZnO, 2.5% $Al_2O_3$, 1.2% CoO and 0.9% $SiO_2$ has been prepared by co-precipitating the hydrated oxides of zinc and aluminum with the hydrated ferric oxide and adding magnetite, silica gel and freshly precipitated $Co(OH)_2$. This specimen has very similar hardness, crush strength and adhesion to Alloy 600 surfaces, to a specimen similarly prepared consisting of about 100% $Fe_2O_3$. Compare Examples 1 and 2, below.

In accordance with a second embodiment of the present invention, radioactive and hazardous species dissolved or suspended in aqueous solutions may be immobilized by precipitating hydrated ferric oxide in the aqueous solution to incorporate some or a substantial fraction of the species. The water content of the resulting hydrated ferric oxide mixture is adjusted and the mixture is pressed, as described above, to produce a hard, solid composition. The contaminants may be incorporated by co-precipitating, sorbing or both, with the ferric oxide. Volume reduction of several hundred times is possible for contaminated aqueous solutions.

Ferric oxide can be precipitated by adding a base and a solution of a ferric salt to the aqueous solution of contaminated waste. The water content can be adjusted, if necessary. Additives may be provided. These steps of the procedure are all discussed above with respect to the first embodiment of the invention. While the co-precipitation or sorption of contaminated materials with hydrated ferric oxide is known, the ability to consolidate the material into a solid composition in accordance with the process of the present invention is surprising.

FIG. 1 is a side view of a solid composition 10 containing contaminated material in accordance with a third embodiment of the invention, produced by either of the processes described above. The solid composition 10 takes the shape of the container or die used in the hot pressing process.

Figure 1A:
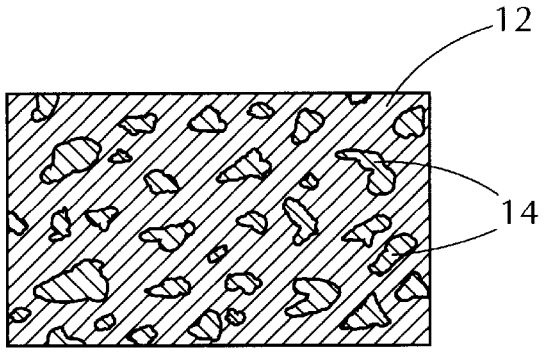
FIG. 1*a* is a micrographic representation of the solid composition of FIG. 1, as it would appear under a scanning electron microscope at a magnification of about 60 times.

FIG. 1*a* is a representation of a micrograph of the composition of FIG. 1, as it would appear under a scanning electron microscope at an enlargement of about 60 times. FIG. 1*a* shows a matrix 12 of ferric oxide with a plurality of particles 14 of contaminated material distributed throughout. The matrix 12 encapsulates the particles 14. The particles 14 have various sizes. As discussed, the particle size is preferably less than about 50 microns.

The ferric oxide content of the solid composition 10 is at least about 20% $Fe_2O_3$ by dry weight of the total weight of the composition. As mentioned above, at least about 30% is preferred. The water content of the composition 10 is preferably between about 0.1% to about 10.0%. More preferably, the water content is between about 2.0–7.0%.

As discussed above, the solid composition 10 is hard, and resistant to leaching and crushing. It has a highly advantageous form for disposal in a containment vessel, and will impede the release of the immobilized contaminated materials, even if the containment vessel itself is broken or disintegrates. Also as mentioned above, it is believed that low level radioactive materials in the nanocurie per gram to millicurie per gram range can be effectively immobilized by the process of the present invention, in the solid composition of the present invention.

According to a fourth embodiment of the present invention, coatings can be provided on surfaces of articles to retard corrosion, for example. A slurry of hydrated ferric oxide is prepared and the water content of the slurry is adjusted if necessary, as discussed above. The resulting moist composition of ferric oxide is deposited on a surface. The water content of the slurry can be adjusted after it is deposited on the surface, as well. The moist composition is then hot pressed for a period of time and water is gradually removed to form a hard, consolidated coating bonded to the surface. It is believed that most metals can be coated in this manner. The process is particularly applicable to metallic surfaces comprising oxide forming metals, such as stainless steel surfaces or surfaces of nickel alloys such as Alloy 600, and metals including chromium, iron, and/or aluminum. Ceramics could be coated, as well. All the surfaces or only some of the surfaces of the object can be coated.

The articles to be coated may be painted with the ferric oxide slurry prior to water content adjustment, placed in a pressure vessel and heated under pressure to gradually reduce the water content and consolidate the coating. A pressing system which enables removal of a large part of the water in the solid as water vapor, such as a die or autoclave connected to a vent or a vacuum line, may be used. Hot rollers may also be used. Water is gradually removed such that the water content of the coating is between about 0.1% to about 10.0%. Preferably, the water content is between about 2.0–7.0%. As above, initial water adjustment and processing within the preferred ranges yields a consolidated coating with a water content within the preferred ranges. The temperature of the hot pressing process is above about 150° C. Since contaminated material is not incorporated in the coating, temperatures of greater than 500° C. can be used, but this would add to the cost of the process. Preferably, the temperature is between about 180–400° C. The thickness of the coating after hot pressing is about half of the thickness of the deposited slurry or moist composition. Initial slurry or moist composition thicknesses of between about 0.1 mm to about 10.0 mm may be used to achieve final coating thicknesses of between about 0.05 mm to about 5.0 mm, for example. Pressures of at least about 15,000 psi, up to about 90,000 psi, may be used for a duration of about 2.5 to 5 hours, for example.

The metal surface of the article to be coated can be placed on the slurry and the article and slurry pressed together, as well. For the purpose of the present invention, the term "deposit" encompasses both the direct application of the slurry or moist composition on the surface, and placement of the article on the slurry or moist composition in a die. For example, an iron based metal disk was coated by placing it in a pellet pressing die wrapped in heating tape and connected to a vacuum line can be used. The slurry was placed on the anvil of the die. The metal disk to be coated was cleaned and placed between the plunger and the slurry. The slurry comprised pure hydrated ferric oxide, which was dried to remove the free-standing water, and then re-wetted to about 25% water, by weight. The die was placed in the press, heated to about 260° C., and uniaxial pressure of 70,000 psi was applied for at least about four hours, for example. The result was a hard, consolidated coating attached to the surface. Optionally, the disk can be pickled with phosphoric acid prior to coating.

It is believed that improved adhesion can be achieved using auxiliary binders such as phosphoric acid or metallic iron powder. Calcium and zinc phosphates may be useful, as well. Lower pressures, such as about 15,000–30,000 psi, can also be used when additives are provided. The use of such binders may facilitate low-pressure coating of large structural elements, where the application of pressure over a large area is impractical. The other additives discussed above may be used as well. The preferred ferric oxide content in this embodiment of the invention is at least about 50%.

Figure 2:
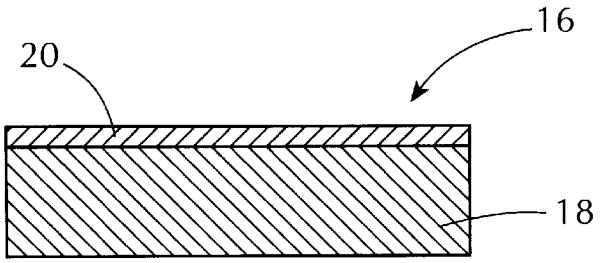
FIG. 2 is a cross-sectional view of a coated article in accordance with the present invention.

FIG. 2 is a cross-sectional view of a coated article 16 in accordance with a fifth embodiment of the invention. The article 16 comprises a substrate 18 of Alloy 600, for example, and a coating 20 of ferric oxide on one surface of the substrate 18.

To evaluate the coating, a disk of Alloy 600 was coated on all sides with a composition of 62.3% $Fe_2O_3$, 16.1% $Fe_3O_4$, 15.1% CuO, 2.6% $Al_2O_3$, 3.0% ZnO, and 0.9% $SiO_2$. The coating was about 1 mm thick. The disk was exposed to an aqueous solution of sodium sulfate ($Na_2SO_4$) in a pressurized vessel. The sulfur in the sodium sulfate was the S-35 beta emitting isotape. The disk was then subjected to stepwise dissolution and the depth of penetration of radioactive sulfate into the coating was measured by monitoring the radioactivity of sequentially dissolved layers. A coating thickness of about 1 mm has been found to be highly effective. A thickness of 10 microns has been found to be sufficient to prevent migration of corrosive species to the surface of the metal. The effectiveness of the coating was also demonstrated by peeling off the coating and conducting microscopic examination of the underlying metal, which was shown to be corrosion-free. See Example 9, below.

The coating process and the coated product of these embodiments of the invention would be advantageous wherever corrosion protection is needed. For example, this coating process could be particularly useful in coating tubes for use in steam generators in nuclear power plants. Other applications include the coating of steel beams in buildings and bridges.

In accordance with a sixth embodiment of the present invention, free-standing ceramic bodies containing at least about 20% ferric oxide, are made. The water content of a slurry of ferric oxide, prepared as described above, is adjusted and the resulting mixture hot pressed, also as described above, to produce the ferric oxide body. As above, the ferric oxide content is at least at 20%. At least about 50% is preferred. As in the coating process of the present invention, temperatures above 500° C. may be used, but are not preferred because of cost. Such ceramic bodies are suitable for applications for which the high density of a ceramic body is advantageous. For example, such ceramic bodies can be used to protect surfaces against corrosion. Such products could also be used in other applications, such as structural elements for construction. The ceramic bodies can be made in the form of tiles, plates, sheets, disks and pipes, for example. The ferric oxide ceramic bodies can be produced in accordance with the process of the present invention in the form and shape most appropriate for the protection of a given surface by appropriate selection of the pressing container or die. The ceramic body can also be machined.

EXAMPLE 1

An aqueous solution of about 29% ammonia was added slowly and with stirring to 100 mL of an aqueous solution containing 47.039 g of $Fe(NO_3)_3.9H_2O$ until the pH reached a steady level of 7.5–8.0. The precipitate produced in this step was filtered to remove the free water.

An aqueous solution of 25% tetramethylammonium hydroxide was added slowly and with stirring to a volume of 30 mL of an aqueous solution containing 0.69 g of $Co(NO_3)_2.6H_2O$ until the pH reached a steady level of 7.5–8.0.

The precipitate produced in this step was added to the filtered precipitate produced in the previous step. The combined precipitate was rinsed with deionized water, dried at 110° C. for 12–18 hours, ball-milled, and sieved to separate the −200 mesh fraction.

0.5 g of the powdered material was mixed with 0.1 mL of water and pressed in a die placed in a hydraulic press under a pressure of about 70,000 psi at a temperature of about 260° C. for 3 hours. The water vapor was gradually removed from the die by a vacuum line. The resulting product was a pellet of iron oxide, including 1.9% cobalt oxide, most probably CoO.

The hardness of the resulting pellet was between 60 and 85 on the Rockwell T scale, using a Rockwell T tester with a 15-kgf load. The crush strength was about 100 lb. The material showed excellent adhesion to stainless steel or Alloy 600 coupons. This Example shows that hydrated ferric oxide can be pressed at moderate temperatures to form a hard, strong solid composition which can be used to immobilize typical radioactive contaminants, such as cobalt oxide containing radioactive isotopes such as cobalt-60 and cobalt-58.

EXAMPLE 2

An aqueous solution of about 29% ammonia was added slowly and with stirring to three aqueous solutions containing:

(a) 47.039 g of $Fe(NO_3)_3.9H_2O$ in a volume of 100 mL;

(b) 2.813 g of $Al(NO_3)_3.9H_2O$ in a volume of 30 mL; and (c) 1.644 g of $Zn(NO_3)_2.6H_2O$ in a volume of 30 mL.

The resulting three precipitates were combined. A suspension of 2.4 g of $Fe_3O_4$ in 10 mL of water and a suspension of 0.15 g of silica gel in 10 mL of water were added to the combined precipitates. The resulting combined precipitates were then filtered.

An aqueous solution of 25% tetramethylammonium hydroxide was added slowly with stirring to two aqueous solutions containing (a) 6.579 g of $Cu(NO_3)_2.2.5H_2O$ in a volume of 30 mL; and (b) 0.69 g of $Co(NO_3)_2.6H_2O$ in a volume of 10 mL. The addition of tetramethylammonium hydroxide continued until the pH reached a steady level of 7.5–8.0.

The resulting two precipitates were added to the filtered precipitate produced above. The resulting combined precipitate was rinsed with de-ionized water, dried at 100° C. for 12–18 hours, ball-milled, and sieved to separate the −200 mesh fraction.

0.5 g of the powdered material was mixed with 0.1 mL of water and pressed in a die placed in a hydraulic press under a pressure of about 70,000 psi at a temperature of about 260° C. for 3 hours, with the water vapor gradually removed from the die by a vacuum line. The resulting product was a pellet with an approximate composition of 61.6% $Fe_2O_3$, 15.9% $Fe_3O4$, 14.9% CuO, 2.5% $Al_2O_3$, 3.0% ZnO, 0.9% $SiO_2$, and 1.2% CoO. The hardness of the resulting pellet was between 60 and 85 on the Rockwell T scale, using a Rockwell T tester with a 15-kgf load. The material showed excellent adhesion to stainless steel or Alloy 600 surfaces.

A comparison of the hardness of this solid with the hardness of the solid made in Example 1 shows that the addition of large amounts, here, about 40%, of other species does not have a significant negative effect on the hardness and strength of the material. This Example also shows that the presence of magnetite, a common corrosion product which often accumulates contaminants, at quantities as large as 15.9% by dry weight, does not have a significant negative effect on the hardness and strength of the material.

EXAMPLE 3

An aqueous solution of about 29% ammonia was added slowly and with stirring to three aqueous solutions containing:

(a) 19.32 g of $Fe(NO_3)_3.9H_2O$ in a volume of 100 mL;

(b) 8.168 g of $A1(NO_3)_3.9H_2O$ in a volume of 30 mL; and (c) 4.058 g of $Zn(NO_3)_2.6H_2O$ in a volume of 30 mL.

The addition of ammonium hydroxide solution continued until the pH reached a steady level of 7.5–8.0. The three precipitates produced in this step were combined. A suspension of 3.82 g of $Cu_2O$ in 20 mL of water and a suspension of 0.14 g of silica gel in 10 mL of water were added to the combined precipitate. The combined precipitate was then filtered. The combined precipitate was rinsed with de-ionized water, dried at 110° C. for 12–18 hours, ball-milled, and sieved to separate the −200 mesh fraction.

0.5 g of the powdered material was mixed with 0.1 mL of water and pressed in a die placed in a hydraulic press under a pressure of about 80,000 psi at a temperature of about 260° C. for 3 hours, with the water vapor gradually removed from the die by means of a vacuum line. The resulting product was a pellet with an approximate composition of 38.2% $Fe_2O_3$, 38.2% $Cu_2O$, 11.1% $Al_2O_3$, 11.1% ZnO and 1.4% $SiO_2$. The hardness of the resulting pellet was between 60 and 85 on the Rockwell T scale, using a Rockwell T tester with a 15-kgf load. The material showed excellent adhesion to stainless steel or Alloy 600 surfaces.

This Example shows that even the addition of more than 60% of other species does not have a significant negative effect on the hardness and strength of the product.

EXAMPLE 4

An aqueous solution of about 29% ammonia was added slowly and with stirring to 100 mL of an aqueous solution containing 48.015 g of $Fe(NO_3)_3.9H_2O$ until the pH reached a steady level of 7.5–8.0. The resulting precipitate was filtered.

An aqueous solution of 25% tetramethylammonium hydroxide was added slowly and with stirring to 30 mL of an aqueous solution containing 0.906 g of $Co(NO_3)_2.6H_2O$ until the pH reached a steady level of 7.5–8.0. The resulting precipitate was added to the filtered precipitate produced above and the combined precipitate was dried at 110° C. for 12–18 hours.

0.25 g of $CsNO_3$ was added to the precipitate. A quantity of 1.0017 g of the combined solid was mixed with 0.22 g of alumina ceramic fiber base adhesive and coating, Cotronics 901, and 0.08 g of silica gel. The combined solid was ball-milled and sieved to separate the −200 mesh fraction.

1 g of the powdered material was mixed with 0.2 mL of water and pressed in a die placed in a hydraulic press under a pressure of about 70,000 psi at a temperature of about 260° C. for 3 hours, with the water vapor gradually removed from the die by a vacuum line. The resulting product was a pellet with an approximate composition of 73.6% $Fe_2O_3$, 17.0% $Al_2O_3$, 5.7% $SiO_2$, 1.9% $CsNO_3$, and 1.8% CoO. The hardness of the resulting pellet was between 60 and 85 on the Rockwell T Scale, using a Rockwell T tester with a 15-kgf load.

Two 1 gram pellets produced according to this Example were subjected to leach testing following the United States Environmental Protection Agency Method 1311—Toxicity Characteristic Leaching Procedure (TCLP, Code of Federal Regulations, Title 40, Chapter I, Jul. 1, 1990 Edition, Part 261, Appendix II). According to this procedure, each 1 g pellet was placed in 20 mL of extraction fluid and rotated end-over-end at a speed of 30 rpm for a period of 18 hours at ambient temperature. The extraction fluids used in the two samples were de-ionized water and an acetic acid—sodium acetate buffer with a pH of 4.93. In addition, 1 g of unpressed powder from the batch used to make the pellets was dissolved in 20 mL of 0.8 M nitric acid to determine the total content of cesium and cobalt. The results of cesium and cobalt analysis of the TCLP extracts and of the dissolved powder were as follows:

| Sample | Cs concentration, mg/L | Co concentration, mg/L |
|---|---|---|
| Powder dissolved in acid | 790 | 530 |
| TCLP extract, DI water | 8 | 1 |
| TCLP extract, pH 4.93 | 22 | 6 |

Since each analysis involved 1 g of the same solid composition and 20 mL of solution, comparison of the results shows that upon exposure to TCLP extraction fluids the consolidated pellet effectively immobilized 99% of the cesium and 99.8% of the cobalt when the extraction fluid is de-ionized water, or 97% of the cesium and 99% of the cobalt when the extraction fluid is a pH 4.93 acetic acid-sodium acetate buffer.

This Example shows that solid compositions comprising a large amount of consolidated ferric oxides are highly effective in immobilizing hazardous waste species, including soluble species such as cesium nitrate.

EXAMPLE 5

An aqueous solution of about 29% ammonia was added slowly and with stirring to an aqueous solution containing 45.997 g of $Fe(NO_3)_3.9H_2O$ until the pH reached 7.5–8.0. A suspension of 0.909 g of yellow mercuric oxide (HgO), −200 mesh, in 10 mL of water was added to the precipitate. The combined precipitate was rinsed with de-ionized water, dried at 110° C. for 18 hours, ball-milled, and sieved to separate the −200 mesh fraction.

0.5 g of the powdered material was mixed with 0.1 mL of water and pressed in a die placed in a hydraulic press under a pressure of about 70,000 psi at a temperature of about 260° C. for 3 hours, with the water vapor gradually removed from the die by a vacuum line. The resulting product was a pellet with an approximate composition of 90% $Fe_2O_3$ and 10% HgO. The hardness of the resulting pellet was between 60 and 85 on the Rockwell T scale, using a Rockwell T tester with a 15-kgf load. The pellet was placed in a volume of 200 mL of de-ionized water for 4 days at 23° C. At the end of this period, the water was tested for the presence of mercury by adding 20 mL of a 1% aqueous solution of sodium sulfide ($Na_2S$). No precipitation and no change of appearance of the water was observed to take place, indicating that no significant amount of mercury leached out of the pellet.

This Example shows that solid compositions comprising a large amount of consolidated ferric oxide are highly effective in immobilizing mercury.

EXAMPLE 6

An aqueous solution of about 29% ammonia was added slowly and with stirring to three aqueous solutions containing:

(a) 20.295 g of $Fe(NO_3)_3.9H_2O$ in a volume of 200 mL;

(b) 8.576 g of $Al(NO_3)_3.9H_2O$ in a volume of 100 mL; and (c) 4.260 g of $Zn(NO_3)_2.6H_2O$ in a volume of 100 mL.

The addition of ammonium hydroxide solution continued until the pH reached a steady level of 7.5–8.0. The three precipitates produced in this step were combined. A suspension of 4.011 g of $Cu_2O$ in 10 mL of water and a suspension of 0.147 g of silica gel in 10 mL of water were added to the combined precipitate. In addition, 4.5 g of Nuclear Grade HCR-S cation exchange resin (H+ form, −100 +200 mesh), previously dried for 18 hours at a temperature of 120° C., was suspended in 10 mL of water and added to the combined precipitate. The resulting precipitate was rinsed with de-ionized water, dried at 100° C. for 18 hours, ball-milled, and sieved to separate the −200 mesh fraction.

0.5 g of the powdered material was mixed with 0.1 mL of water and pressed in a die placed in a hydraulic press under a pressure of about 70,000 psi at a temperature of about 260° C. for 3 hours, with the water vapor gradually removed from the die by means of a vacuum line. The hardness of the resulting pellet was between 60 and 85 on the Rockwell T scale, using a Rockwell T tester with a 15-kgf load.

This Example shows that solid compositions comprising a large amount of consolidated ferric oxide can be used to immobilize ion exchange resins.

EXAMPLE 7

An aqueous solution of about 29% ammonia was added slowly and with stirring to an aqueous solution containing 26.564 g of $Fe(NO_3)_3.9H_2O$ until the pH reached 7.5–8.0. A slurry of 5.25 g of metallic iron fines in 10 mL of water was added to the precipitate. The size of the iron fines was less than 100 microns. In addition, 4.5 g of Nuclear Grade HCR-S cation exchange resin (H+ form, −100 +200 mesh), previously dried for 18 hours at a temperature of 120° C., was suspended in 10 mL of water and added to the precipitate. The combined precipitate was rinsed with de-ionized water, dried at 110° C. for 18 hours, ball-milled, and sieved to separate the −200 mesh fraction.

0.5 g of the powdered material was mixed with 0.1 mL of water and pressed in a die placed in a hydraulic press under a pressure of about 25,000 psi at a temperature of about 260° C. for 3 hours, with the water vapor gradually removed from the die by a vacuum line. The hardness of the resulting pellet was between 60 and 85 on the Rockwell T scale, using a Rockwell T tester with a 15-kgf load.

This Example shows that the use of additives such as a metallic iron during the hot pressing step of the preparation of solid compositions comprising a large amount of consolidated ferric oxides allow significant lowering of the pressure at which the hot pressing operation is performed.

EXAMPLE 8

An aqueous solution of about 29% ammonia was added slowly and with stirring to an aqueous solution containing 37.948 g of $Fe(NO_3)_3.9H_2O$ until the pH reached 7.5–8.0. 7.5 g of MagSep™ polymeric sorbent, about 10 microns in size, was suspended in 20 mL of water and added to the precipitate. The combined precipitate was rinsed with de-ionized water, dried at 110° C. for 18 hours, ball-milled, and sieved to separate the −200 mesh fraction.

0.5 g of the powdered material was mixed with 0.1 mL of water and pressed in a die placed in a hydraulic press under a pressure of about 70,000 psi at a temperature of about 260° C. for 3 hours, with the water vapor gradually removed from the die by a vacuum line. The hardness of the resulting pellet was between 60 and 85 on the Rockwell T scale, using a Rockwell T tester with a 15-kgf load.

This Example shows that solids comprising a large amount of consolidated ferric oxide can be used to immobilize polymeric materials.

EXAMPLE 9

A slurry with an approximate composition of 62.3% $Fe_2O_3$, 16.1% $Fe_3O_4$, 15.1% CuO, 2.6% $Al_2O_3$, 3.0% ZnO, and 0.9% $SiO_2$ was prepared by the method of Example 2, and deposited over an Alloy 600 disc by pressing in a die, also as in Example 2. The thickness of the slurry was about 2 mm and the final thickness of the coating was about 1 mm. The coated disc was exposed in a pressurized vessel to an aqueous solution of $Na_2SO_4$, wherein the sulfur was the S-35 beta-emitting isotope, for a period of 11 days at a temperature of 180° C. Following the exposure, 10-micron thick layers of the coating were successively dissolved in 2 M hydrochloric acid. The solutions were neutralized and mixed with scintillation fluid.

Subsequent beta activity measurements using a scintillation counter showed no activity above background except in the case of the outermost 10-micron layer. The rate of migration of sulfate in the ferric oxide was very low, less than $1.5.10^{-17}$ $m^2s^{-1}$ at 180° C. The ferric oxide material was, therefore, very effective in retarding the migration of corrosive sulfate ions toward the underlying Alloy 600 pellet.

More generally, this Example shows that solid coatings or coverings comprising a large amount of consolidated ferric oxide can be highly effective in retarding corrosion of surfaces, particularly metal surfaces.

We claim:

1. A process for immobilizing solid contaminated materials comprising:

mixing the contaminated materials with hydrated ferric oxide, wherein the mixture comprises at least about 20% $Fe_2O_3$, by dry weight of the total weight of the mixture, the mixture having a water content; and pressing the mixture at a temperature of at least about 150° C. and gradually removing a large part of the water content of the mixture while under pressure for a sufficient period of time to produce a solid composition containing the contaminated material.

2. The process of claim 1, further comprising reducing the particle size of the contaminated material to less than about 50 microns prior to the mixing step.

3. The process of claim 1, wherein a majority of the hydrated ferric oxide comprises ferrihydrite.

4. The process of claim 1, further comprising adding to the mixture at least one material selected from the group consisting of a second metal oxide, a ceramic binder, alumina, silica, a silicate, an aluminosilicate, a phosphate, phosphoric acid, titania, a titanate, and metal fines, before pressing.

5. The process of claim 4, wherein the pressing step is conducted at a pressure of at least about 15,000 psi.

6. The process of claim 1, wherein the amount of the hydrated ferric oxide as $Fe_2O_3$ is at least about 30% by dry weight of the total weight of the mixture.

7. The process of claim 1, wherein the pressing step is conducted at less than about 500° C.

8. The process of claim 7, wherein the pressing step is conducted at between about 180° C. to about 400° C.

9. The process of claim 1, wherein the pressing step comprises removing sufficient water such that the water content of the solid composition is between about 2.0% to about 7.0%.

10. The process of claim 1, further comprising adjusting the water content of the mixture to between about 5% to about 40%, before pressing.

11. The process of claim 10, further comprising adjusting the water content of the mixture to between about 10% to about 30%, before pressing.

12. The process of claim 1, further comprising precipitating the hydrated ferric oxide prior to the mixing step by combining a base with a ferric salt at a pH of about 7.5–8.0.

13. The process of claim 1, wherein the pressing step is conducted at a pressure of at least about 60,000 psi.

14. The process of claim 13, wherein the hot pressing step is conducted for a period of time of at least about 2.5 hours.

15. A process for immobilizing contaminated solid materials comprising radioactive materials, non-radioactive hazardous materials or both, the process comprising:

mixing the solid materials with hydrated ferric oxide, wherein the mixture comprises at least about 30% $Fe_2O_3$, by dry weight of the total weight of the mixture, the mixture having a water content;

adjusting the water content of the mixture to between about 10% to about 30%; and pressing the mixture at a pressure of between about 15,000 psi to about 90,000 psi, at a temperature of between about 180° C. to about 400° C. and gradually removing a large part of the water content of the mixture while under pressure for a sufficient period of time to produce a solid composition containing the contaminated materials.

16. The process of claim 15, wherein the pressing step is conducted for a period of time of between about 2.5 hours to about 5 hours.

17. A process for immobilizing contaminated materials contained in an aqueous solution, comprising:

precipitating hydrated ferric oxide in the solution to incorporate at least a fraction of the contaminated materials, wherein the hydrated ferric oxide comprises at least about 20% $Fe_2O_3$, by dry weight of the total weight of the precipitate, the precipitate having a water content; and pressing the precipitate at a temperature of at least 150° C. and gradually removing a large part of the water content of the precipitate while under pressure for a sufficient period of time to produce a solid composition containing the contaminated materials.

18. The process of claim 17, further comprising adding to the resulting precipitate at least one material selected from the group consisting of a second metal oxide, a ceramic binder, alumina, a silicate, an aluminosilicate, a phosphate, phosphoric acid, titania, a titanate and metal fines, before pressing.

19. The process of claim 18, wherein the pressing step is conducted at a pressure of at least about 15,000 psi.

20. The process of claim 17, wherein the amount of the hydrated ferric oxide is at least about 30% $Fe_2O_3$ by dry weight of the total weight of the precipitate.

21. The process of claim 17, wherein the pressing step is conducted at a temperature less than about 500° C.

22. The process of claim 17, wherein the pressing step is conducted at a temperature between about 180° C. to about 400° C.

23. The process of claim 17, further comprising adjusting the water content of the precipitate to between about 5–40%, before pressing.

24. The process of claim 23, further comprising adjusting the water content to between about 10% to about 30%, before pressing.

25. The process of claim 17, wherein the precipitating step comprises co-precipitating the hydrated ferric oxide with the contaminated materials.

26. The process of claim 17, wherein the precipitating step comprises sorbing the contaminated materials with the hydrated ferric oxide.

27. The process of claim 17, wherein the precipitating step is conducted at a pH of about 7.5–8.0.

28. The process of claim 17, wherein a majority of the hydrated ferric oxide comprises ferrihydrite.

29. The process of claim 17, wherein the pressing step comprises removing sufficient water such that the water content is between about 2.0% to about 7.0%.

30. The process of claim 17, wherein the pressing step is conducted at a pressure of between about 60,000 psi to about 90,000 psi.

31. The process of claim 30, wherein the pressing step is conducted for a period of time of at least about 2.5 hours.

32. A process for immobilizing contaminated materials comprising radioactive materials, non-radioactive hazardous materials or both, dissolved or suspended in an aqueous solution, comprising:

precipitating hydrated ferric oxide in the solution to incorporate a substantial fraction of the contaminated materials, wherein the hydrated ferric oxide comprises at least about 30% $Fe_2O_3$, by dry weight of the total weight of the precipitate, the precipitate having a water content;

adjusting the water content of the resulting precipitate to between about 10% to about 30%; and pressing the resulting precipitate at a temperature of between about 180° C. to about 400° C. and gradually removing a large part of the water content of the precipitate while under a pressure of about 15,000 psi to about 90,000 psi for a sufficient period of time to produce a solid composition.

33. The process of claim 32, wherein the pressing step is conducted for a period of time of between about 2.5 to 5 hours.

34. A process for coating one of a metal and a ceramic surface comprising:

depositing on the surface a moist composition comprising hydrated ferric oxide and water, the composition comprising at least about 20% $Fe_2O_3$, by dry weight of the total weight of the moist composition, the moist composition having a water content; and pressing the deposited moist composition at a temperature of at least about 150° C. and gradually removing a large part of the water content of the moist composition while under pressure for a period of time to produce a solid coating adhered to the surface.

35. The process of claim 34, further comprising adding to the moist composition at least one additive selected from the group consisting of a second metal oxide, a ceramic binder, alumina, silica, a silicate, an aluminosilicate, a phosphate, phosphoric acid, titania, a titanate and metal fines, before pressing.

36. The process of claim 34, wherein the pressing step is conducted at between about 180° C. to about 400° C.

37. The process of claim 34, further comprising adjusting the water content of the moist composition to between about 10% to about 30%, before pressing.

38. The process of claim 34, wherein the pressing step is conducted at a pressure of at least about 15,000 psi.

39. A process for producing a ceramic body, comprising:

forming a moist composition comprising precipitated hydrated ferric oxide and water, wherein the moist composition comprises at least about 50% $Fe_2O_3$, by dry weight of the total weight of the moist composition, the moist composition having a water content; and pressing the moist composition at a temperature of at least about 150° C. and gradually removing a large part of the water content of the moist composition while under pressure for a sufficient period of time to produce a solid composition.

40. The process of claim 39, further comprising adding to the moist composition at least one additive selected from the group consisting of a second metal oxide, a ceramic binder, alumina, silica, a silicate, an aluminosilicate, a phosphate, phosphoric acid, titania, a titanate and metal fines, before pressing.

41. The process of claim 39, wherein the pressing step is conducted at a temperature between about 180° C.–400° C.

42. The process of claim 39, further comprising adjusting the water content of the moist composition to between about 10% to about 30%, before pressing.

43. The process of claim 39, wherein the pressing step is conducted at a pressure of at least about 15,000 psi for a period of time of at least about 2.5 hours.

44. The process of claim 39, wherein the pressing step comprises pressing the moist composition into a predetermined shape.

45. A solid composition comprising a matrix of ferric oxide and contaminated material distributed throughout and encapsulated by the matrix.

46. The solid composition of claim 45, having a water content of between about 0.1% to about 10%.

47. The solid composition of claim 45, having a water content of between about 2.0% to about 7.0%.

48. The solid composition of claim 45, wherein the contaminated material comprises radioactive material, non-radioactive hazardous material or both.

49. The solid composition of claim 45, wherein the contaminated material comprises particles having sizes less than about 50 microns.

50. The solid composition of claim 45, further comprising at least one material selected from the group consisting of a second metal oxide, a ceramic binder, alumina, silica, a silicate, an aluminosilicate, a phosphate, phosphoric acid, titania, a titanate and metal fines.

51. The solid composition of claim 50, wherein the at least one material comprises up to 80% of the total weight of the composition.

52. The solid composition of claim 45, dimensioned to fit into a containment vessel.

53. The solid composition of claim 45, having a hardness of at least about 60 on the Rockwell T Scale.

54. A disposable consolidated composition comprising:

a matrix of ferric oxide comprising at least about 30% of the composition and having a water content of between about 2.0% to about 7.0%;

contaminated material distributed throughout the matrix, wherein the matrix encapsulates the contaminated material; and at least one additive chosen from the group consisting of a second metal oxide, a ceramic binder, alumina, silica, a silicate, an aluminosilicate, a phosphate, phosphoric acid, titania, a titanate, and metal fines.

55. A solid composition comprising a matrix of ferric oxide and contaminated material distributed throughout and encapsulated by the matrix, formed by:

mixing the contaminated materials with hydrated ferric oxide, the mixture comprising at least about 20% $Fe_2O_3$, by dry weight of the total weight of the mixture, the mixture having a water content; and pressing the mixture at a temperature of at least about 150° C. and gradually removing a large part of the water content of the mixture while under pressure for a sufficient period of time to produce the solid composition comprising the matrix of ferric oxide and the contaminated material.

56. The solid composition of claim 55, wherein the matrix further comprises at least one material chosen from the group consisting of a second metal oxide, a ceramic binder, alumina, silica, a silicate, an aluminosilicate, a phosphate, phosphoric acid, titania, a titanate, and metal fines, distributed throughout; and the mixture is pressed at a pressure of at least about 15,000 psi;

the water content of the mixture is adjusted to between about 10% to about 30% prior to pressing; and said at least one of said materials is added to the mixture prior to pressing.

57. The process of claim 39, wherein the moist composition is mixed with contaminated materials before pressing, such that the resulting solid composition contains the contaminated material.

58. The process of claim 39, wherein the moist composition is deposited on one of a metal and a ceramic surface before pressing, and the deposited moist composition is pressed against the surface to produce a solid composition adhered to the surface.

59. The process of claim 1, which comprises mixing the contaminated material with a slurry of hydrated ferric oxide and water.

60. The process of claim 59, wherein the slurry is formed by adding a base to a solution of ferric oxide at a ph in the near-neutral to alkaline range.

61. The process of claim 59, further comprising adjusting the water content of the mixture to between about 5% to about 40%, before pressing.

62. The process of claim 34, wherein a majority of the hydrated ferric oxide comprises ferrihydrite.

63. The process of claim 34, wherein the amount of the hydrated ferric oxide as $Fe_2O_3$ is at least about 30% by dry weight of the total weight of the mixture.

64. The process of claim 34, wherein the pressing step is conducted at less than about 500° C.

65. The process of claim 34, wherein the pressing step comprises removing sufficient water such that the water content of the solid composition is between about 2.0% to about 7.0%.

66. The process of claim 34, further comprising adjusting the water content of the mixture to between about 5% to about 40%, before pressing.

67. The process of claim 34, further comprising precipitating the hydrated ferric oxide prior to the mixing step by combining a base with a ferric salt at a pH of about 7.5–8.0.

68. The process of claim 34, wherein the pressing step is conducted at a pressure of at least about 60,000 psi.

69. The process of claim 68, wherein the hot pressing step is conducted for a period of time of at least about 2.5 hours.

70. The process of claim 39, wherein a majority of the hydrated ferric oxide comprises ferrihydrite.

71. The process of claim 39, wherein the amount of the hydrated ferric oxide as $Fe_2O_3$ is at least about 30% by dry weight of the total weight of the mixture.

72. The process of claim 39, wherein the pressing step is conducted at less than about 500° C.

73. The process of claim 39, wherein the pressing step comprises removing sufficient water such that the water content of the solid composition is between about 2.0% to about 7.0%.

74. The process of claim 39, further comprising adjusting the water content of the mixture to between about 5% to about 40%, before pressing.

75. The process of claim 39, further comprising precipitating hydrated ferric oxide by combining a base with a ferric salt at a pH of about 7.5–8.0.

76. The process of claim 39, wherein the pressing step is conducted at a pressure of at least about 60,000 psi.

77. The process of claim 76, wherein the hot pressing step is conducted for a period of time of at least about 2.5 hours.

78. A process for coating one of a metal and a ceramic surface comprising:

depositing on the surface a composition comprising hydrated ferric oxide, the composition comprising at least about 20% $Fe_2O_3$, by dry weight of the total weight of the composition, the composition having a water content; and pressing the deposited composition at a temperature of at least about 150° C. and gradually removing a large part of the water content of the composition while under pressure for a period of time to produce a solid coating adhered to the surface.

79. The process of claim 78, further comprising adjusting the water content of the composition to between about 5% to about 40% before the depositing step.

80. The process of claim 79, further comprising adjusting the water content of the composition to between about 10% to about 30% before the depositing step.

81. The process of claim 79, further comprising adding to the composition at least one material selected from the group consisting of a second metal oxide, a ceramic binder, alumina, silica, a silicate, an aluminosilicate, a phosphate, phosphoric acid, titania, a titanate, and metal fines, before pressing.

82. A process for producing a ceramic body, comprising:

forming a composition comprising hydrated ferric oxide, wherein the hydrated ferric oxide comprises at least about 50% $Fe_2O_3$, by dry weight of the total weight of the composition, the composition having a water content; and pressing the composition at a temperature of at least about 150° C. and gradually removing a large part of the water content of the composition while under pressure for a sufficient period of time to produce a solid composition.

83. The process of claim 82, further comprising adjusting the water content of the composition to between about 5% to about 40%, before pressing.

84. The process of claim 83, further comprising adjusting the water content of the composition to between about 10% to about 40%, before pressing.

85. The process of claim 82, further comprising adding to the composition at least one material selected from the group consisting of a second metal oxide, a ceramic binder, alumina, silica, a silicate, an aluminosilicate, a phosphate, phosphoric acid, titania, a titanate, and metal fines, before pressing.

86. The process of claim 82, wherein a majority of the hydrated ferric oxide is ferrihydrite.

* * * * *